US007015889B2

(12) United States Patent
Ahn et al.

(10) Patent No.: US 7,015,889 B2
(45) Date of Patent: Mar. 21, 2006

(54) METHOD AND APPARATUS FOR REDUCING OUTPUT VARIATION BY SHARING ANALOG CIRCUIT CHARACTERISTICS

(75) Inventors: Sung Tae Ahn, Palo Alto, CA (US); Yung Jin Jeon, Uwang-si (KR); Chan Young Jeong, Seongnam-si (KR); Keunmyung Lee, Palo Alto, CA (US)

(73) Assignee: Leadis Technology, Inc., Sunnyvale, CA (US)

( * ) Notice: Subject to any disclaimer, the term of this patent is extended or adjusted under 35 U.S.C. 154(b) by 162 days.

(21) Appl. No.: 10/232,593

(22) Filed: Aug. 30, 2002

(65) Prior Publication Data

US 2003/0058233 A1 Mar. 27, 2003

Related U.S. Application Data

(60) Provisional application No. 60/325,258, filed on Sep. 26, 2001.

(51) Int. Cl.
*G09G 5/00* (2006.01)

(52) U.S. Cl. ..... 345/98; 345/100

(58) Field of Classification Search ..... 345/98, 345/100, 204, 211–213, 690, 691, 205
See application file for complete search history.

(56) References Cited

U.S. PATENT DOCUMENTS 5,170,158 A * 12/1992 Shinya ..... 345/204
5,572,211 A * 11/1996 Erhart et al. ..... 341/144
5,670,973 A * 9/1997 Bassetti et al. ..... 345/58
5,684,502 A 11/1997 Fukui et al.
5,689,280 A 11/1997 Asari et al.
5,747,363 A 5/1998 Wei et al.
5,754,157 A 5/1998 Kuwata et al.
5,764,212 A 6/1998 Nishitani et al.
5,786,799 A 7/1998 Matsui et al.
5,818,409 A 10/1998 Furuhashi et al.
5,852,429 A 12/1998 Scheffer et al.
5,877,738 A 3/1999 Ito et al.
5,900,856 A 5/1999 Iino et al.
6,040,815 A * 3/2000 Erhart et al. ..... 345/211
6,097,352 A 8/2000 Zavracky et al.
6,252,572 B1 6/2001 Kurumisawa et al.
6,373,459 B1 * 4/2002 Jeong ..... 345/100
6,417,827 B1 * 7/2002 Nagao et al. ..... 345/211
6,483,497 B1 11/2002 Iino et al.
6,522,317 B1 * 2/2003 Satou et al. ..... 345/98
6,611,246 B1 8/2003 Ito
6,664,943 B1 * 12/2003 Nakajima et al. ..... 345/98
6,750,839 B1 * 6/2004 Hogan ..... 345/98
6,847,369 B1 * 1/2005 Lavelle et al. ..... 345/558
6,856,308 B1 * 2/2005 Akimoto et al. ..... 345/98

(Continued)

FOREIGN PATENT DOCUMENTS

EP 837446 A1 * 4/1998

(Continued)

*Primary Examiner*—Amare Mengistu
(74) *Attorney, Agent, or Firm*—Fenwick & West LLP

(57) ABSTRACT

A scheme to reduce output variations in a column driver for a flat-panel display by sharing the characteristics of analog circuit is disclosed. An input multiplexer is provided between two neighboring digital inputs, and an output multiplexer is provided between two neighboring analog outputs so that the characteristics of neighboring analog circuits can be shared by multiplexing. The averaging effect by sharing reduces variations in the output. The multiplexing may be done either in time division or on a frame-by-frame basis.

3 Claims, 3 Drawing Sheets

U.S. PATENT DOCUMENTS

| | | | | |
|---|---|---|---|---|
| 2001/0028346 | A1 | 10/2001 | Kudo et al. | |
| 2001/0038385 | A1 | 11/2001 | Negoi et al. | |
| 2001/0050662 | A1 | 12/2001 | Kota et al. | |
| 2002/0149608 | A1 * | 10/2002 | Bu et al. | 345/690 |
| 2002/0158585 | A1 | 10/2002 | Sundahl | |
| 2003/0011298 | A1 | 1/2003 | Palanisamy | |
| 2004/0056852 | A1 * | 3/2004 | Shih et al. | 345/204 |
| 2004/0174347 | A1 * | 9/2004 | Sun et al. | 345/204 |
| 2004/0227713 | A1 * | 11/2004 | Sun | 345/98 |
| 2005/0052379 | A1 * | 3/2005 | Waterman | 345/87 |
| 2005/0225517 | A1 * | 10/2005 | Sun | 345/76 |

FOREIGN PATENT DOCUMENTS

| | | | |
|---|---|---|---|
| JP | 2000-172236 | A | 6/2000 |
| JP | 2000-258751 | A | 9/2000 |

* cited by examiner

METHOD AND APPARATUS FOR REDUCING OUTPUT VARIATION BY SHARING ANALOG CIRCUIT CHARACTERISTICS

RELATED APPLICATION

This application claims the benefit of co-pending U.S. Provisional Application Ser. No. 60/325,258, filed Sep. 26, 2001, entitled "Method and Apparatus for Reducing Output Variation by Sharing Analog Circuit Characteristics."

BACKGROUND OF THE INVENTION

1. Technical Field

This invention in general relates to semiconductor circuits. More specifically, this invention relates to circuits for sharing analog circuit characteristics in flat-panel displays to compensate for variations in the outputs.

2. Description of the Related Art

FIG. 1 shows a conventional driver circuit for a flat panel display in general. Each digital input is converted to an analog value by a digital-to-analog (D/A) converter and buffered before an output is generated. For example, Data 1 of n-bits is converted by D/A1 to an analog value, which is then buffered to produce Out1.

Ideally, one digital input should produce the same analog output in different columns. In practice, however, for the same digital input, there are column-to-column deviations in the output because there are variations in the analog characteristics of the D/A converters and buffers due to many reasons such as processing variations.

Therefore, there is a need for a scheme to compensate for the output deviations due to variations in the analog circuit characteristics.

SUMMARY OF THE INVENTION

It is an object of the present invention to compensate for any output deviations due to variations in the analog circuit characteristics.

The foregoing and other objects are accomplished by sharing the characteristics of multiple neighboring analog circuits. Provided for each column are an input multiplexer for multiplexing neighboring digital inputs into one and an output multiplexer for multiplexing neighboring analog outputs into one. Sharing the characteristics of the neighboring analog circuits through multiplexing may be done in time division. Alternatively, sharing the characteristics of the neighboring analog circuits may be done on a frame basis. For example, at every n frames, different analog circuits may be selected for driving the outputs.

DETAILED DESCRIPTION OF THE INVENTION

Figure 1:
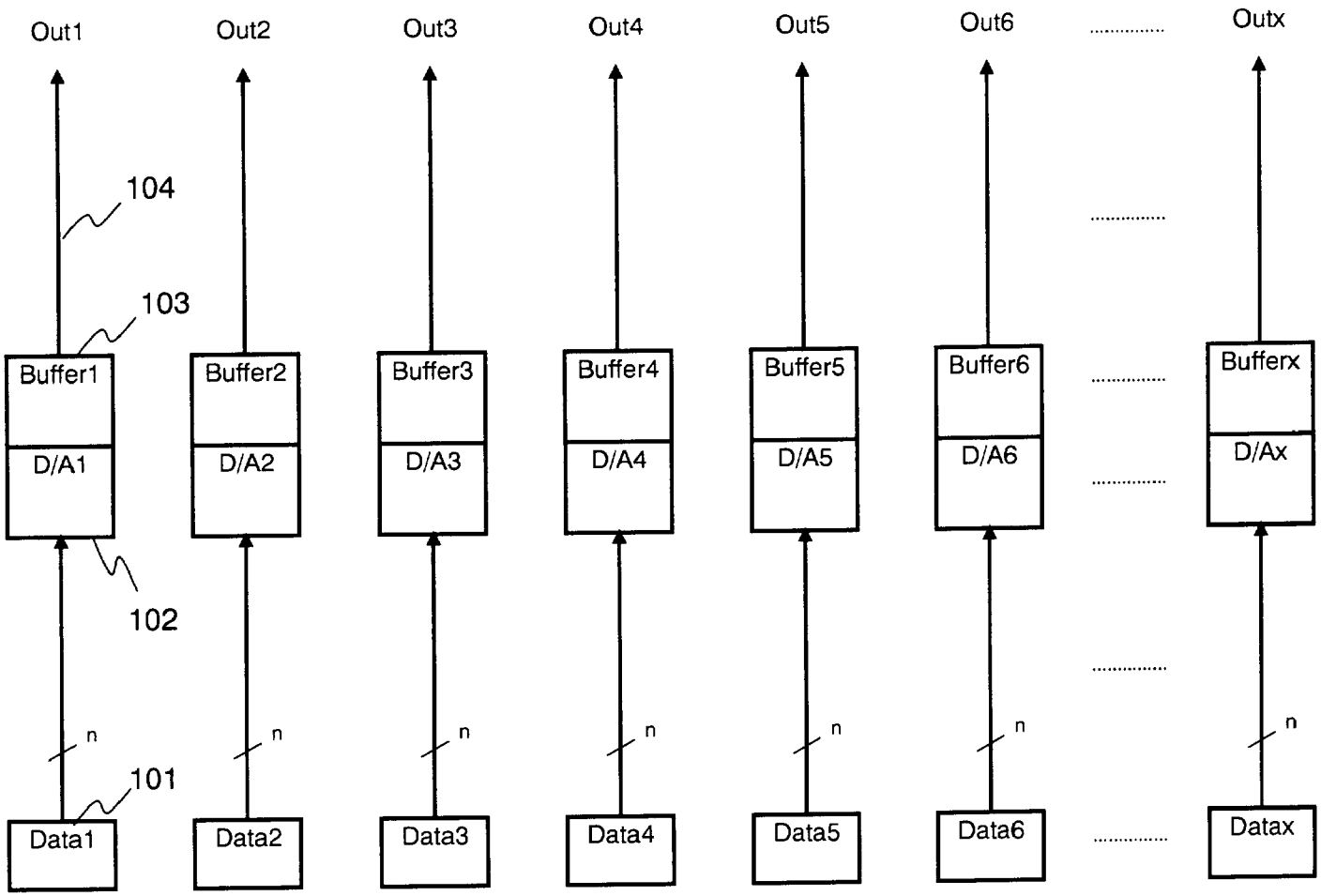
FIG. 1 (Prior Art)
FIG. 1 is a schematic of a prior art output driver.
Figure 2:
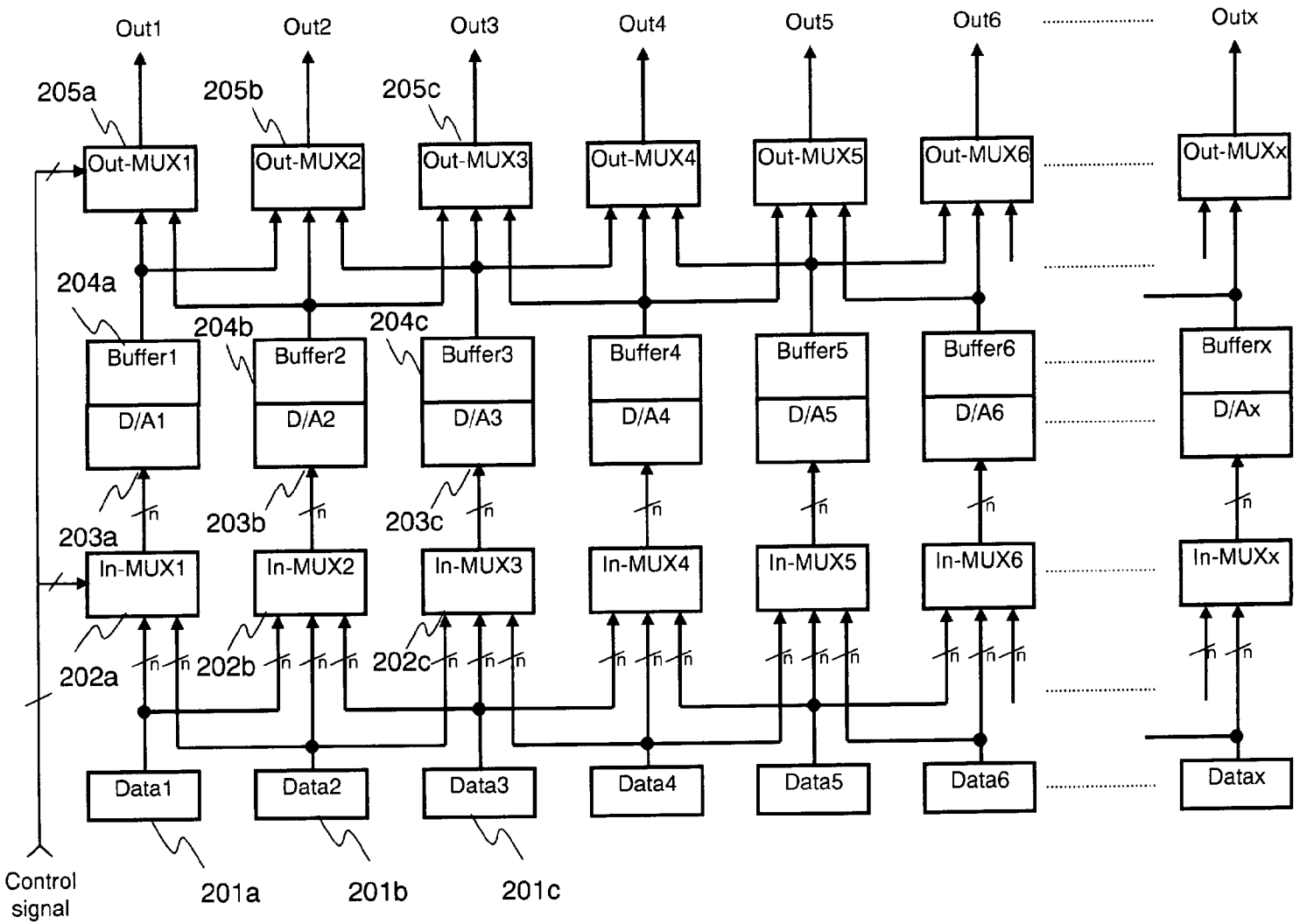
FIG. 2 is a schematic of an output driver of the present invention using multiplexing.

FIG. 2 shows a scheme of the present invention for reducing output variation. The driver circuit shown in FIG. 2 includes multiple columns, where each column corresponds to one of the digital inputs (Data1, Data2, . . . , DataX) and one of the analog outputs (Out1, Out2, . . . , Outx), respectively. The driver circuit includes a plurality of input multiplexers (In-MUX1, In-MUX2, . . . , In-MUXx), and each input multiplexer selects an input from a plurality of the digital inputs (Data1, Data2, . . . , DataX). The driver circuit also includes a plurality of digital-to-analog converters (D/A1, D/A2, . . . , D/Ax), and each digital-to-analog converter connects to one of the input multiplexers to receive input from the corresponding input multiplexer and generate analog output data corresponding to the received digital input data. The driver circuit also includes a plurality of buffers (Buffer1, Buffer2, . . . , Bufferx), and each buffer is connected to one of the digital-to-analog converters to receive and buffer the corresponding analog output data. The driver circuit also includes a plurality of output multiplexers for outputting the analog outputs (Out1, Out2, . . . , Outx), and each output multiplexer selects an input from a plurality of buffers to output the analog output data. In other words, each column is provided with an input multiplexer (In-MUX) for selecting among inputs from multiple neighboring digital inputs and an output multiplexer (Out-MUX) selecting one among outputs from multiple neighboring analog outputs. For example, In-MUX2 is provided for the column corresponding to Data2 and Out2 to select one among three inputs, Data1, Data2, and Data3. Similarly, Out-MUX2 is provided for the column corresponding to Data2 and Out2 to select one among three outputs Buffer1, Buffer2, and Buffer3. The input multiplexers and the output multiplexers are controlled to select different digital-to-analog converters in different time slots for driving the analog outputs, whereby the analog outputs from the driver share neighboring analog characteristics of the digital-to-analog converters used.

Figure 3A:
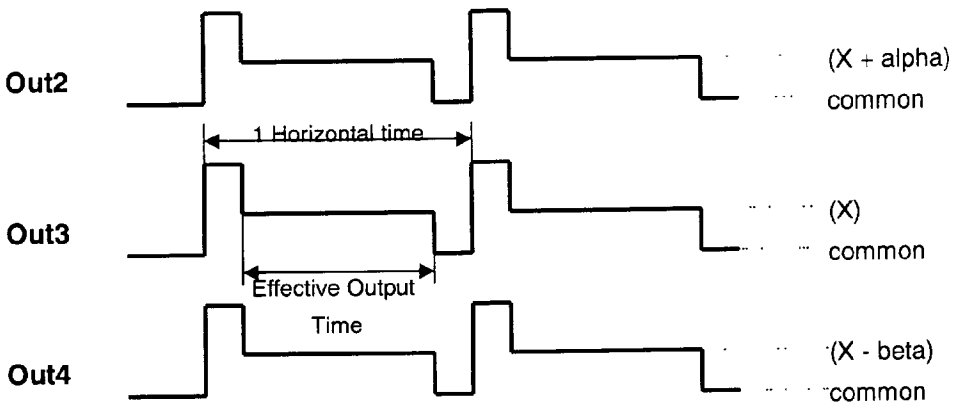
FIGS. 3A and 3B are illustrations of an averaging effect by sharing the characteristics of neighboring analog circuits.
Figure 3B:
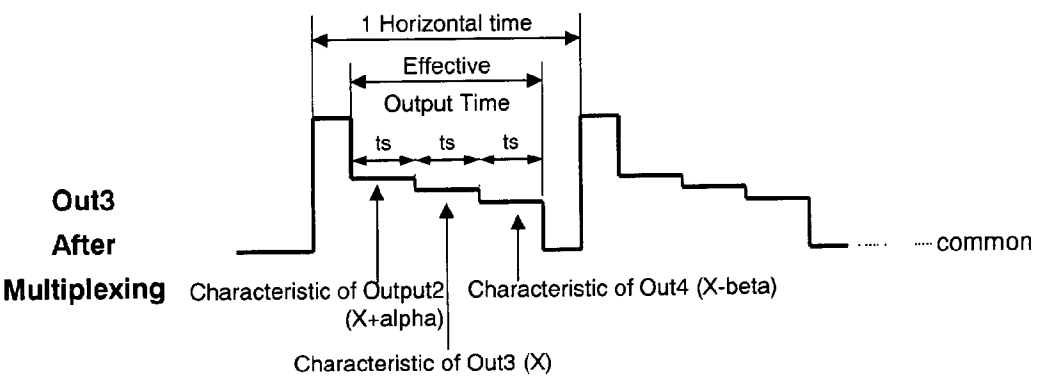

FIGS. 3A and 3B illustrate an averaging effect obtained by sharing the characteristics of the analog circuits. The example shows the case where the effective output time is divided into three time slots, and a different analog circuit drives the output during each time slot. The averaging effect reduces the output variations to any variation in the analog device characteristics. For example, referring to FIG. 2 in conjunction with FIGS. 3A and 3B, input multiplexers In-MUX3, In-MUX2, and In-MUX4 correspond to digital inputs Data3, Data2, and Data4, respectively. In-MUX2 selectively outputs Data3 during a first time slot ("ts" or period), In-MUX3 selectively outputs Data3 during a second time slot, and In-MUX4 selectively outputs the Data3 during a third time slot. D/A converters, D/A3, D/A2, and D/A4, are coupled to In-MUX3, In-MUX2, and In-MUX4, respectively. D/A2 converts the output of In-MUX2 to analog output data Out3 during the first time slot, D/A3 converts the output of In-MUX3 to analog output data Out3 during the second time slot, and D/A4 converts the output of In-MUX4 to analog output data Out3 during the third time slot. Buffer2 buffers the analog output data Out3 received from the D/A2 during the first time slot, Buffer3 buffers the analog output data Out3 received from the D/A3 during the second time slot, and Buffer4 buffers the analog output data Out3 received from the D/A4 during the third time slot. Output multiplexer Out-MUX3 selectively outputs the analog output data Out3 received from D/A2 and Buffer2 during the first time slot, selectively outputs the analog output data Out3 received from D/A3 and Buffer3 during the second time slot, and the analog output data Out3 received from D/A4 and Buffer4 during the third time slot. Therefore, during the first time slot, the digital input Data3 is selected by In-MUX2, converted to analog output data Out3 by D/A2, which is buffered by Buffer2, and selectively output by Out-MUX3. During the second time slot, the digital input Data3 is selected by In-MUX3, converted to analog output data Out3 by D/A3, which is buffered by Buffer3, and selectively output by Out-MUX3. During the third time slot, the digital input Data3 is selected by In-MUX4, converted to analog output data Out3 by D/A4, which is buffered by Buffer4, and selectively output by Out-MUX3. As a result, the analog characteristics of D/A2 and Buffer2, D/A3 and Buffer3, and D/A4 and Buffer4 are averaged during the effective output time including the first time slot, the second time slot, and the third time slot, when generating the output data Out3, as shown in FIGS. 3A and 3B.

Sharing the characteristics of the analog circuits may be done on a frame-by-frame basis. For example, in every n frames, the multiplexers may switch the analog circuits driving the outputs.

While the invention has been described with reference to preferred embodiments, it is not intended to be limited to those embodiments. It will be appreciated by those of ordinary skilled in the art that many modifications can be made to the structure and form of the described embodiments without departing from the spirit and scope of this invention.

What is claimed is:

1. A driver circuit for a display device for converting digital input data corresponding to a plurality of columns of the display device including at least a first column, a second column, and a third column to analog output data corresponding to the plurality of columns, comprising:

a plurality of input multiplexers including at least a first input multiplexer, a second input multiplexer, and a third input multiplexer corresponding to the first column, the second column, and the third column, respectively, the second input multiplexer selectively outputting first digital input data for driving the first column during a first period, the first input multiplexer selectively outputting the first digital input data during a second period, and the third input multiplexer selectively outputting the first digital input data during a third period;

a plurality of digital-to-analog converters including at least a first digital-to-analog converter, a second digital-to-analog converter, and a third digital-to-analog converter coupled to the first input multiplexer, the second input multiplexer, and the third input multiplexer, respectively, the second digital-to-analog converter converting the first digital input data received from the second input multiplexer to first analog output data during the first period, the first digital-to-analog converter converting the first digital input data received from the first input multiplexer to the first analog output data during the second period, and the third digital-to-analog converter converting the first digital input data received from the third input multiplexer to the first analog output data during the third period; and a plurality of output multiplexers including at least a first output multiplexer, a second output multiplexer, and a third output multiplexer corresponding to the first, second and third columns, respectively, the first output multiplexer selectively outputting the first analog output data received from the second digital-to-analog converter during the first period and selectively outputting the first analog output data received from the first digital-to-analog converter during the second period and selectively outputting the first analog output data received from the third digital-to-analog converter during the third period to drive the first column with the first analog output data.

2. The driver circuit of claim 1, wherein the first column is adjacent to the second column and the third column.

3. The driver circuit of claim 1, further comprising a plurality of buffers including at least a first buffer, a second buffer, and a third buffer, the second buffer buffering the first analog output data received from the second digital-to-analog converter for outputting to the first output multiplexer during the first period, the first buffer buffering the first analog output data received from the first digital-to-analog converter for outputting to the first output multiplexer during the second period, and the third buffer buffering the first analog output data received from the third digital-to-analog converter for outputting to the first output multiplexer during the third period.

* * * * *